United States Patent [19]

Blanck

[11] Patent Number: 4,519,105

[45] Date of Patent: May 28, 1985

[54] APPARATUS FOR CLOSING TOILET SEAT COVER

[76] Inventor: James R. Blanck, 8401 Remmet St., Canoga Park, Calif. 91304

[21] Appl. No.: 601,016

[22] Filed: Apr. 16, 1984

[51] Int. Cl.[3] ..... A47K 17/00

[52] U.S. Cl. ..... 4/661; 4/251

[58] Field of Search ..... 4/661, 251, 236, 234

[56] References Cited

U.S. PATENT DOCUMENTS

| | | | |
|---|---|---|---|
| 1,999,555 | 4/1935 | Adams | 4/251 |
| 2,758,315 | 8/1956 | Hylton | 4/251 |
| 3,191,193 | 6/1965 | Bogenberger | 4/251 |
| 3,717,884 | 2/1973 | Mantooth | 4/251 X |
| 3,935,601 | 2/1976 | Hermann | 4/251 |

*Primary Examiner*—Henry K. Artis

*Attorney, Agent, or Firm*—Allan M. Shapiro

[57] ABSTRACT

Handle guard is positioned with respect to the cover of a toilet seat so that when the toilet seat cover is raised, the handle guard is positioned adjacent the flush handle on the toilet tank to inhibit access to the flush handle. In order to achieve access to the flush handle, the user must pull the handle guard away, which causes closure of the toilet seat cover.

18 Claims, 3 Drawing Figures

FIG. 1
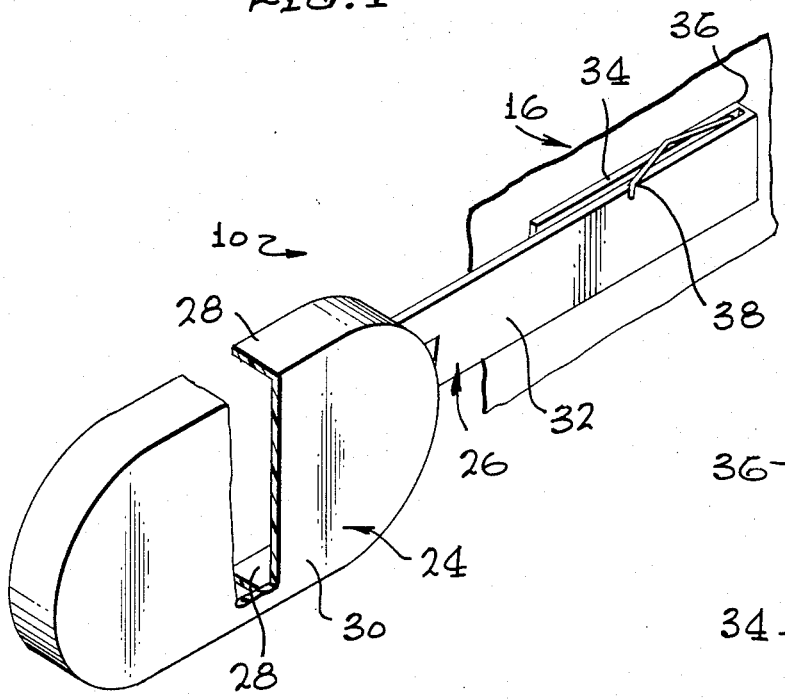
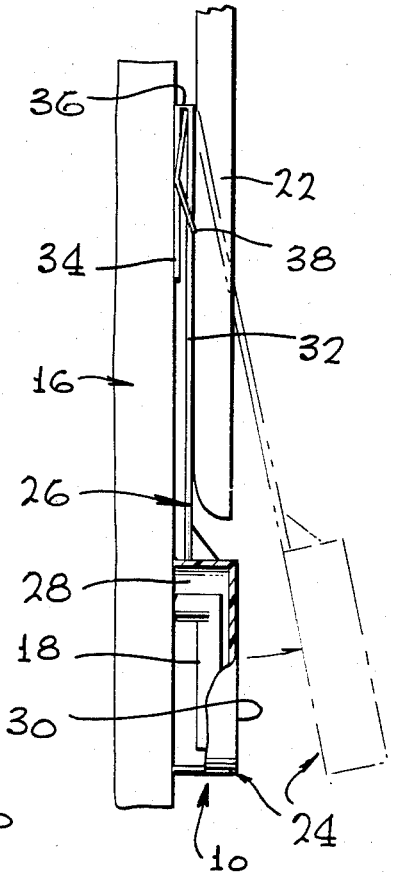
FIG. 3
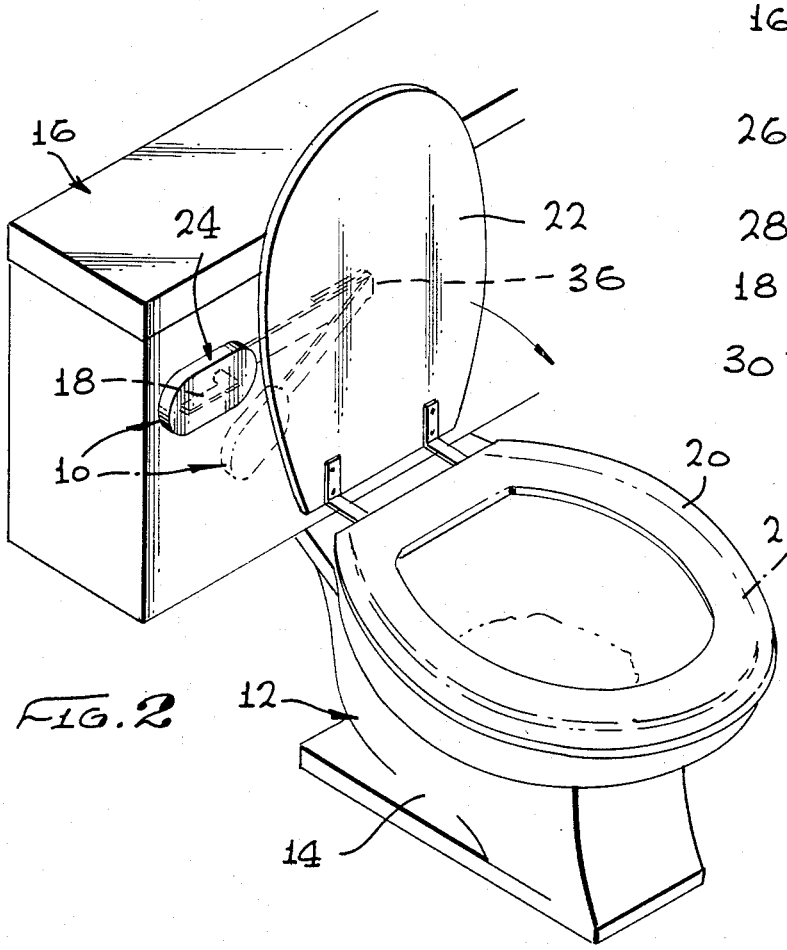
FIG. 2

APPARATUS FOR CLOSING TOILET SEAT COVER

BACKGROUND OF THE INVENTION

This invention is directed to an apparatus for closing the cover on a toilet seat wherein a handle guard must be moved away from the toilet flush handle in order to reach the flush handle, and this movement of the handle guard causes closing of the toilet seat cover.

An open toilet is dangerous implement for small children. Toddlers are unsteady and have poor strength and balance. They roam the house; they find the water in the toilet bowl to be a thing of curiosity. Most children like the water of their bath and, upon seeing the water in the toilet bowl, they may want to play therein. It has been known that young children have fallen head first into a toilet bowl. In view of their short arms, limited strength and smooth bowl sides, the result has been drowning. Therefore, safety would be enhanced if the toilet seat cover was closed down over the seat except during use of the toilet.

SUMMARY OF THE INVENTION

In order to aid in the understanding of this invention it can be stated in essentially summary form that it is directed to an apparatus for closing the cover on a toilet seat, with the handle guard positioned and shaped so that when the toilet seat cover is raised, the handle guard inhibits access to the toilet flush handle and when the handle guard is moved away from the flush handle, it causes closing of the toilet seat cover.

It is, thus, an object and advantage of this invention to provide an apparatus for closing a toilet seat cover whereby the user of the toilet cannot easily reach the toilet flush handle without at least partway lowering the toilet seat cover toward the closed position, to provide substantial assurance that the toilet seat cover will be closed when the person leaves the vicinity.

It is a further object and advantage of this invention to provide an apparatus which includes a handle guard which covers or inhibits access to the flush handle on the toilet tank when the toilet seat cover is raised and when the handle guard is moved away from the flush handle, the toilet seat cover is forced toward its closed position a sufficient distance so that gravity will cause completion of closure of the toilet seat cover.

It is a further object and advantage of this invention to provide an apparatus for closing a toilet seat cover wherein the apparatus is inexpensive to build and market, yet is reliable and is applicable to toilets and toilet seat covers of various shapes and configurations so that the apparatus can be widely used for the purposes of safety.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is a isometric view of the apparatus for closing a toilet seat cover, in accordance with this invention, with parts broken away and parts taken in section.

FIG. 2 is another isometric view thereof, showing the apparatus in association with a toilet having a toilet seat cover.

FIG. 3 is a plan view, on larger scale than FIG. 2, of the apparatus in association with a toilet and a toilet seat cover, with parts broken away and parts taken in section.

DESCRIPTION OF THE PREFERRED EMBODIMENTS

The apparatus for closing a toilet seat cover in accordance with this invention is generally indicated at 10 in FIGS. 1, 2 and 3. It is shown in association with toilet 12. Toilet 12 is of conventional construction. It has a bowl 14 and a tank 16. Flush handle 18 is mounted on the front of the tank. Upon manual actuation of the flush handle 18, it actuates internal mechanism within tank 16 to release the water within tank 16 down through bowl 14 to flush toilet 12.

Most toilets found in the home have a toilet seat 20 hingedly mounted therein. In addition, toilet seat cover 22 is hingedly mounted, usually on the same hinge axis as the toilet seat, so that it can be swung from a cover-closed position to a cover-open position, such as shown in FIG. 2.

In order to effect the closing of toilet seat cover 22 after use of the toilet, in order to avoid the dangerous condition described above, the apparatus 10 is provided to associated with the toilet for closing the toilet seat cover. The apparatus 10 is preferably an integral molding of handle guard 24 and arm 26. Handle guard 24 is a cup-shaped member which has walls 28 and front 30 to enclose several sides of a space. When in place, the toilet flush handle 18 is within that space, as seen in FIG. 3. While the handle guard is shown as a cup, with walls extending all the way around the front 30, some of those walls may be eliminated, if desired. For example, the bottom wall, at the lower edge of front 30, as seen in FIG. 1, may not be necessary to inhibit access to the flush handle 18. The cup of handle guard 24 is sufficient to receive and accept the flush handle 18.

Arm 26 is preferably integrally molded with handle guard 24 and the arm itself has two portions. Lever 32 and mounting plate 34 are molded together in line with each other and are joined by a living hinge 36. Living hinge 36 is of the same material, is molded at the same time and is merely a section of reduced thickness where hinging can occur. The apparatus 10 is injection-molded of a material suitable for the production of the living hinge. Polypropylene is particularly suitable for such use. Lever 32 is of generally rectangular section to provide adequate strength in the up-and-down direction, as installed. Similarly, the hinge 36 needs length in that same vertical direction to constrain lever 32 and handle guard 24 carried thereon to arcuate motion toward and away from the flush handle 18. Thus, they may be the same dimension in the vertical direction as installed.

Mounting plate 34 is preferably of the same width, in the vertical direction, as shown in FIG. 1. Mounting plate 34 has sufficient area that it may be adhesively attached to the front of toilet tank 16 as shown. Thus, it may be of greater dimension in the width of the mounting plate, in the vertical direction. Spring 38 engages both lever 32 and mounting plate 34 adjacent hinge 36. Spring 38 is stressed to urge the lever toward the mounting plate and permits moving the lever away from the mounting plate against the stress of the hinge.

Mounting plate 34 is adhesively attached to the front of tank 16 in such a position that handle guard 24 engages over flush handle 16. In addition, lever 32 extends behind the toilet seat cover 22 when it is in the raised position, as shown in FIG. 2. When located in this position, when it is desired to flush the toilet, the handle guard 24 must be moved away from flush handle 18 in order to permit access to the flush handle. The only direction of motion permitted by hinge 36 in arcuate motion in the forward direction, in the direction of the arrows shown in FIGS. 2 and 3. This causes lever 32 to swing forward around its hinge and engage on the top of the raised toilet seat cover. By further motion of lever 32 to the dotted line position shown in FIGS. 2 and 3, toilet seat cover 22 is forced sufficiently far forward that it falls to the closed position. This achieves the purpose of closing the toilet seat cover to enhance safety.

The apparatus 10 is a preferred embodiment because it completely engages around the operative part of the flush handle 18 to fully inhibit access to the flush handle when the toilet seat cover is in the raised position and causes closing of the toilet seat cover when access is desired. Other types of handle guards can be employed as long as they provide the function of inhibiting access to the flush handle when the toilet seat is in the raised position and are mounted to cause closing of the toilet seat cover when access is attempted.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An apparatus for closing a toilet seat cover comprising:

a handle guard configured to interact with a toilet flush handle on a toilet tank when said handle guard is in a first position to inhibit access to the flush handle; and attachment means for movably attaching said handle guard to a toilet tank so that when the toilet seat cover is in a raised position, said handle guard is in said first position wherein said handle guard inhibits access to the flush handle and said attachment means also being for moving the toilet seat cover toward the closed position upon movement of said handle guard away from its first position to achieve access to the toilet flush handle.

2. The apparatus for closing a toilet seat cover in accordance with claim 1 wherein said handle guard is carried on a lever and said lever extends behind the toilet seat cover when the toilet seat cover is in the raised position.

3. The apparatus for closing a toilet seat cover in accordance with claim 2 wherein said lever is hingedly mounted.

4. The apparatus for closing a toilet seat cover in accordance with claim 3 further comprising a mounting plate for attachment to a toilet tank, said lever being hingedly mounted to said mounting plate.

5. The apparatus for closing a toilet seat cover in accordance with claim 4 wherein said handle guard and said lever are integrally molded of synthetic polymer composition material.

6. The apparatus for closing a toilet seat cover in accordance with claim 4 wherein said lever and said mounting plate are integrally molded of synthetic polymer composition material and said hinge is a living hinge molded therewith and therebetween.

7. The apparatus for closing a toilet seat cover in accordance with claim 6 wherein said handle guard is integrally molded with said lever.

8. An apparatus for closing a toilet seat cover comprising:

a handle guard configured to interact with a toilet flush handle on a toilet tank when said handle guard is in a first position to inhibit access to the flush handle, said handle guard being carried on a lever, with said lever extending behind the toilet seat cover when the toilet seat cover is in a raised position; and attachment means including a hinge for hingedly attaching said lever carrying said handle guard to the toilet tank with a spring engaged with said lever adjacent said hinge to swing said lever in a direction to urge said handle guard to cover said handle so that when the toilet seat cover is in a raised position, said handle guard is in said first position wherein said handle guard inhibits access to the flush handle and said attachment means also being for moving the toilet seat cover toward the closed position upon movement of said handle guard away from its first position to achieve access to the toilet flush handle.

9. An apparatus for closing a toilet seat cover comprising:

a handle guard configured to interact with a toilet flush handle on a toilet tank when said handle guard is in a first position to inhibit access to the flush handle, said handle guard being carried on a lever, said lever extending behind the toilet seat cover when the toilet seat cover is in the raised position;

a mounting plate for attachment to a toilet tank, said lever and said mounting plate being integrally molded of synthetic polymer composition material and a living hinge molded with said lever and said mounting plate and positioned therebetween so that said lever and said handle guard are hingedly mounted with respect to said mounting plate, a spring engaged with said lever adjacent said hinge to swing said lever in a direction to urge said handle guard to cover the handle so that when the toilet seat cover is in a raised position, said handle guard is in said first position wherein said handle guard inhibits access to the flush handle, said handle guard moving the toilet seat cover toward the closed position upon movement of said handle guard away from its first position to achieve access to the toilet flush handle.

10. An apparatus for closing a toilet seat cover comprising:

mounting means for mounting in a toilet tank;

a lever movably mounted on said mounting means;

a handle guard means secured on said lever, said handle guard means being sized and configured for engaging with respect to a toilet flush handle so as to inhibit access to the flush handle when said handle guard is in a first position and said handle guard means being for permitting access to the flush handle when said handle guard is in a second position, said lever being positioned so that when said handle guard moves from its first position toward its second position, said lever engaged on a toilet seat cover to thrust it from a raised position toward a closed position.

11. The apparatus for closing a toilet seat cover in accordance with claim 10 wherein said handle guard is secured to said lever and said lever is hingedly mounted on said mounting means.

12. The apparatus for closing a toilet seat cover in accordance with claim 11 wherein said mounting means is for attachment to a toilet tank in a position where said mounting means is covered by the toilet seat cover when the toilet seat cover is in its raised position.

13. The apparatus for closing a toilet seat cover in accordance with claim 12 wherein said lever and said mounting means are molded of synthetic polymer composition material and said hinge is a self hinge molded therewith.

14. An apparatus for closing a toilet seat cover comprising:

mounting means for mounting on a toilet tank in a position where said mounting means is covered by the toilet seat cover when the toilet seat cover is in a raised position, said mounting means including a hinge;

a lever mounted on said hinge so that said lever is hingedly mounted on said mounting means, a spring engaged between said lever and mounting means;

a handle guard mounted on said lever, said handle guard being sized and configured to engage with respect to a toilet flush handle so as to inhibit access to the flush handle when said handle guard is in a first position and permit access to the flush handle when said handle guard is in a second position, said spring urging said lever in a direction such that said handle guard is urged from its second position toward its first position, said lever being positioned so that when said handle guard moves from its first position toward its second position, said lever engages on the toilet seat cover to thrust it from a raised position toward a closed position.

15. The apparatus for closing a toilet seat cover in accordance with claim 14 wherein said lever and said mounting means are molded of synthetic polymer composition material and said hinge is a self hinge molded therewith.

16. The apparatus for closing a toilet seat cover in accordance with claim 10 wherein said handle guard is cup-shaped so that it substantially embrances the flush handle when said handle guard is in its first position.

17. Apparatus for closing a toilet seat cover comprising:

a lever;

a mounting plate, a hinge interconnecting said lever and said mounting plate;

a handle guard mounted on said lever, said handle guard, said lever, said hinge and said mounting plate being integrally molded of synthetic polymer composition material with said hinge being a living hinge;

a spring interconnecting said lever and said mounting plate to urge said lever from a second position toward a first position, said mounting plate being for mounting on a toilet tank in such a position that a portion of said lever is covered by the toilet seat cover when it is in its raised position and said mounting plate is secured to the toilet tank in such a position that when said lever is in its first position said handle guard substantially embraces the toilet flush handle to inhibit access thereto, said lever being shaped so that when said handle guard is moved away from the flush handle by hinging on said hinge and urging against said spring in a direction from said first position toward said second position, said lever engages the toilet seat cover to move the toilet seat cover from its raised position toward its closed position.

18. The apparatus for closing a toilet seat cover in accordance with claim 17 wherein said mounting plate is for adhesive attachment to the front of the toilet tank.

* * * * *